United States Patent [19]

Kloss

[11] Patent Number: 5,046,104

[45] Date of Patent: Sep. 3, 1991

[54] LOUDSPEAKER SYSTEM

[75] Inventor: Henry E. Kloss, Cambridge, Mass.

[73] Assignee: Cambridge Soundworks, Inc., Newton, Mass.

[21] Appl. No.: 444,115

[22] Filed: Nov. 30, 1989

[51] Int. Cl.[5] ..... H04R 1/02

[52] U.S. Cl. ..... 351/90; 351/188; 351/205; 181/151

[58] Field of Search ..... 181/141, 151, 146, 148, 181/153, 160; 381/87, 88, 90, 188, 205

[56] References Cited

U.S. PATENT DOCUMENTS

| | | | |
|---|---|---|---|
| 3,416,804 | 12/1968 | Christie | 181/146 |
| 3,473,625 | 10/1969 | Heisrath | 181/146 |
| 4,408,095 | 10/1983 | Ariga et al. | 381/27 |
| 4,939,912 | 7/1990 | Leonovich, Jr. | 381/90 |

*Primary Examiner*—Forester W. Isen

*Attorney, Agent, or Firm*—Gaston & Snow

[57] ABSTRACT

A portable loudspeaker system that includes loudspeaker means for reproducing relatively high audio frequencies, and amplifier means, and further includes a carrying case formed as a relatively rigid, low-density, releasably matable pair of polystyrene shells that define an enclosed interior space when mated. Mounted in an opening through a wall of one of the shells is a woofer for reproducing only relatively low audio frequencies as acoustic waves radiating away from said case. Disposed within the case is a body of sound absorbing polyurethane foam that has a plurality of relatively large voids for respectively storing the loudspeaker means, the amplifier means and an optional sound source such as a compact disc player.

12 Claims, 1 Drawing Sheet

LOUDSPEAKER SYSTEM

This invention relates to sound reproduction, and particularly to portable apparatus for reproducing sound from a plurality of loudspeakers.

The term "loudspeaker" as used herein is intended to refer to an individual electroacoustic transducer for reproducing audio signals. Audio signals are typically reproduced by an individual loudspeaker unit or by an assemblage of such units (which arrangement is hereinafter referred to as a loudspeaker system). Particularly, reproduction of sound below about 150 Hz is usually effected by one or more low-frequency speakers known as a woofers or subwoofers having little or no directional characteristics. Reproduction of sound above about 150 Hz is generally accomplished using an arrangement of at least a mid-range speaker and a tweeter in a spatially predetermined relation in an enclosure. A stereophonic system thus would typically incorporate two or more of such loudspeaker systems (typically two or more mid-range and tweeter combinations and at least one woofer) spatially separated from one another and selected so as to provide substantially full range radiation of audio frequencies.

In an usual prior art arrangement of a stereophonic loudspeaker system, a listener with normal hearing typically is positioned in front of and equidistant from equivolume radiating speakers of at least a pair of such loudspeaker systems, the right and left loudspeaker systems respectively reproducing the right and left stereo channels. In such case, the listener will theoretically perceive equal-sound amplitude components from the two speakers with an illusion of depth. In practice, however, the listener's perception is largely mediated by the characteristics of the hearing room in which the speakers are disposed, in accordance with the reflected ambient versions of the sound arriving later in time. Listeners often express a preference for sound reproduced through stereophonic headphones which serve to isolate the recorded signals by blocking out impinging ambience of the listening room. Notwithstanding the discomfort and limited acoustic performance, principally in the bass register, for audiophiles, headphones have been a valid alternative to loudspeakers.

Thus, it is difficult to judge how a system will sound until one has had an opportunity to experience the performance of the systems in the actual listening environment. This is particularly true with respect to portable loudspeaker systems that may be used in a number of different environments depending upon the travels of the listener.

A principal object of the present invention is therefore to provide a portable loudspeaker system including components that can be readily distributed about a listening room at locations that will provide acoustic balance and imaging optimized for the particular listener's taste. Other objects of the present invention are to provide such a loudspeaker system that will provide stereophonic reproduction; and to provide such a loudspeaker system that will include a rugged, light weight, portable carrying case for the components, which case also constitutes the enclosure for a relatively low-frequency loudspeaker.

The foregoing and other objects of the present invention are exemplified by a portable loudspeaker system that includes typically a separate amplifier and at least one and preferably more, loudspeaker assemblies for reproducing relatively high audio frequencies. The system also comprises a woofer for reproducing only relatively low audio frequencies, and a carrying case formed as a releasably matable pair of substantially rigid shells which, when mated, define an enclosed interior space. The woofer is mounted in an opening through the wall of one of the shells so as to radiate the reproduced relatively low frequencies away from said case, using the enclosed interior space of the closed case as a loudspeaker enclosure. A body of sound absorbing material is shaped to fit within the interior space of the case for preventing formation of standing waves of low frequencies within the case space during operation of said woofer, the body being also shaped to provide a plurality of relatively large voids in which the separate loudspeaker assemblies and amplifier can be stored and transported.

Other objects of the present invention will in part appear obvious and will in part appear hereinafter. The invention accordingly comprises the apparatus possessing the features, properties and relation of elements, all of which are exemplified in the following detailed disclosure and the scope of the application of which will be indicated in the claims.

For a fuller understanding of the nature and objects of the present invention, reference should be had to the following detailed description taken in connection with the accompanying drawings in which like numerals denote like parts, and wherein.

Figure 1:
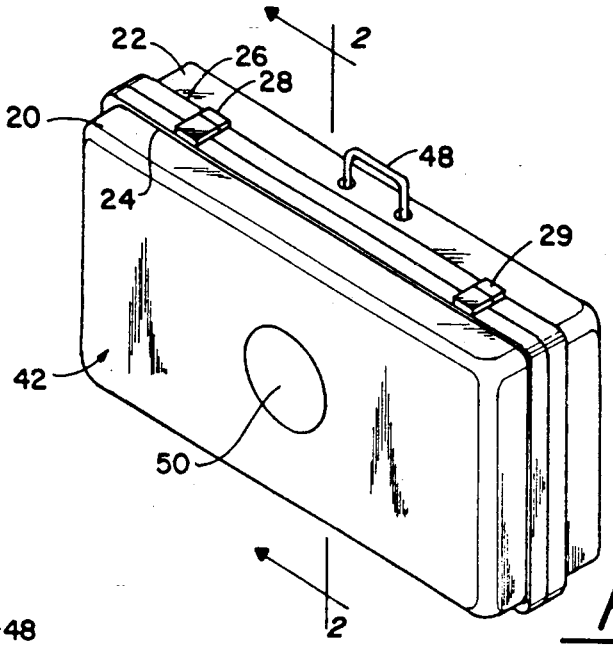
FIG. 1 is a perspective view of a carrying case embodying the principles of the present invention.
Figure 2:
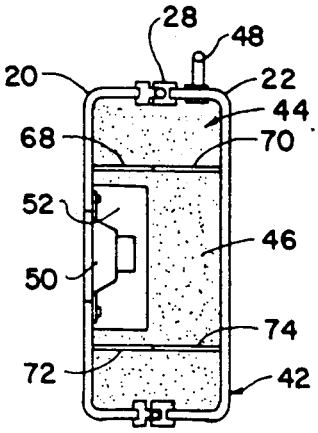
FIG. 2 is a cross-sectional view of the case of FIG. 1 taken along the line 2—2 showing the mounting of the woofer on a wall of the case and the details of the coupling between the shells of the case.

Referring to the drawings, there is shown in FIGS. 1-4 inclusive, an embodiment of the present invention comprising a pair of relatively thin-walled, hollow compartments or shells 20 and 22, the respective peripheries or rims 24 and 26 of which are shaped to be congruent or matable with one another. Shells 20 and 22 are preferably thermoplastically molded from a light weight material such as polystyrene beads to provide a very stiff shell with a substantially uniform wall thickness in the range of about 0.56 to 0.625 inches, and a density of about 8 lbs/ft$^3$. To protect the exterior surfaces of the shells and to add further strength thereto, those surfaces are preferably provided with a coating, such as an adhesively, vacuum-formed film (ca. 0.028 inch thick) of a high impact material such as ABS or an acrylic/polyvinyl chloride compound such as a polymer sold under the trade name of Kydex by Rohm & Haas Co., or the like. Similarly, in a preferred embodiment, the interior surfaces of the shells are also coated, typically with a film (ca. 0.040 inch thick) of high impact strength polymer such as the same acrylic/polyvinyl chloride compound. In a preferred form, each shell has a depth of about 2 to 2.5 inches and has a substantially rectangular external periphery of nominally about 19.5×16 inches with corners being rounded on 14 inch radii.

Means, such as clamps or toggle bolts 28 and 29 (and others not shown) are mounted adjacent rims 24 and 26 and are engageable with corresponding elements for releasably coupling the shells together at the rims. To insure that the peripheries of the shells, when coupled, are held together rigidly in a hermetic seal as shown particularly in detail in FIG. 3, rims 24 and 26 are respectively provided with edging strips 30 and 31, typically in the form of elongated metal extrusions having in cross-section respective channels 32 and 34 extending along the length of the strips and dimensioned to fit snugly over respective rims 24 and 26, the channels being typically locked to the rims by adhesive or the like. Strip 30 is provided with flange 36 projecting from strip 30 oppositely to channel 32 and extending substantially along the entire length of strip 30. Similarly, strip 31 is provided with groove 38 facing oppositely and parallel to channel 34, groove 38 being preferably interiorly dimensioned to loosely embrace flange 36. To insure that strips 30 and 31 will form a hermetic seal when flange 36 is emplaced in groove 38, the latter is lined with a resiliently deformable, flexible bead 40, preferably formed from a polymer foam sponge, for example of neoprene or the like.

When mated, as shown in FIG. 1, the shells thus define a case 42 having hollow interior space 44. As shown particularly in FIG. 2, space 44 is largely occupied by body 46 of sound absorbent material such as a fiberglass or Dacron filament bat, but preferably an open-celled foam typically formed of polyurethane having a density of about 2 lbs/ft$^3$, and an average pore size of about 0.006 inch. Means, such as handle 48, is affixed to an exterior portion of case 42 for manually lifting and holding the latter.

Rigidly mounted and sealed in an opening through a wall of one of the shells such as 20 is at least one speaker or woofer 50 preferably with an 8 inch cone on a well-known acoustic suspension, and adapted to reproduce only audio frequencies in a relatively low range (e.g., from about 160 Hz to 40 Hz), speaker 50 being disposed to radiate reproduced acoustic waves at those low frequencies away from case 42. It will thus be appreciated that when case 42 is closed, the latter constitutes an optimized low frequency speaker enclosure inasmuch as it (1) is formed of a stiff material that will not deform substantially at the acoustic pressures and frequencies generated by woofer 50, and (2) is filled with sufficient sound-absorbent material in the form of body 46 that, being open foam, both provides a stiff-air spring to effect a restoring force on the speaker cone, and serves to prevent air column resonances and standing waves from forming within the enclosure. The use of an acoustic suspension speaker for woofer 50 allows one to provide an acoustically optimum volume for case 42 that is typically quite small (e.g., 3 to 4 ft$^3$) and thus is easily portable.

Figure 3:
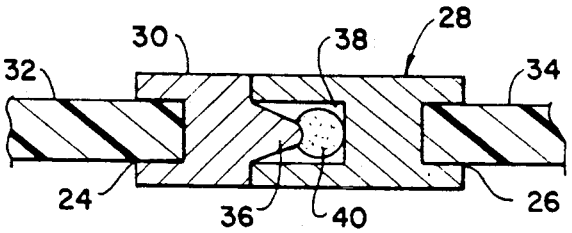
FIG. 3 is an enlarged cross-sectional view of a fragment of the embodiment of FIG. 2.
Figure 4:
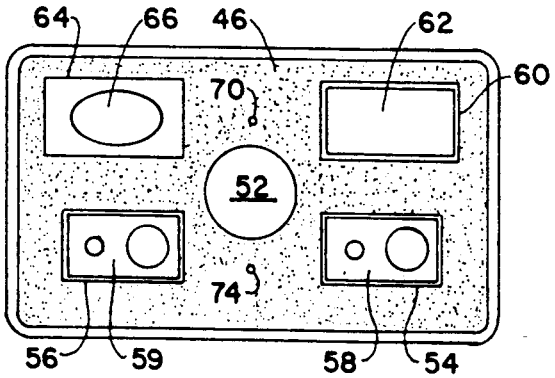
FIG. 4 is a view of the embodiment of FIG. 1 taken when the case is open, showing the configuration of the interior foam body.

Body 46, as shown particularly in FIG. 4, is provided with a number of voids therein, a first one 52 of which is positioned to provide the desired volume for the back of woofer 50 to extend into interior space 44 of case 42. Disposed in accordance with the choice of the designer, may be other such voids in body 46. For example, body 46, as shown in FIG. 3 is provided with voids 54 and 56 dimensioned to accept and temporarily store for transport therein a corresponding pair of loudspeaker assemblies 58 and 59 for reproducing relatively high audio frequencies (e.g., 160 Hz to 15 KHz or higher). Body 46 also includes void 60 for storing and transporting amplifier 62, the latter preferably being a three-channel amplifier capable of amplifying signals to be fed to woofer 50 and assemblies 58 and 59, and typically operable at both 50 and 60 cycles at 110 or 220 volts, or 12 volts DC. Body 46 further includes another void 64 for storing and transporting an electrical sound source 66 such as a portable compact disc player, a radio receiver or the like, together with external connections or leads (not shown).

In order to insure that when shells 20 and 22 are fitted together to form the desired speaker enclosure "drumhead" vibration of the shells will be minimized during operation of speaker 50, compressive bracing is provided. Such bracing typically comprises posts 68 and 72 respectively fixed to the interior surface of shell 20 on opposite sides of speaker 50 and extending therefrom into interior space 44 substantially normally to the mean plane of shell 20. Another similar pair of posts, 70 and 74 are mounted on the interior surface of shell 22 and extend therefrom into space 44. Posts 70 and 74 are so disposed and dimensioned that when shells 20 and 22 are locked together, the free ends of posts 70 and 74 respectively contact the free ends of respective posts 68 and 72 and are held in such contact by compression from the shells, thus providing the desired bracing.

It will be appreciated that when the filled case has been transported to a site at which it is desired to reproduce sound, clamps 28, 29 and any others are released to permit case 42 to be opened so that one may have access to the interior. Components other than woofer 50 are then removed from case 42 and shells 20 and 22 are recoupled to form the woofer enclosure. The leads then are used to connect source 66, amplifier 62, speaker assemblies 58 and 59 and woofer 50 together, with the speakers being disposed at locations dictated by the wishes of the listener and the length of the leads.

Since certain changes may be made in the above product and method without departing from the scope of the invention involved, it is intended that all matter contained in the above description or shown in the accompanying drawings shall be interpreted in an illustrative and not in a limiting sense.

What is claimed is:

1. A portable loudspeaker system including at least one loudspeaker assembly for reproducing relatively high audio frequencies, and amplifier means, said system comprising, in combination:

a carrying case formed as a mating pair of shells which, when mated, define an enclosed interior space; at least one of said shells having mounted in an opening through a wall thereof at least one woofer for reproducing only relatively low audio frequencies as acoustic waves radiating substantially away from said case, said case being formed of a stiff material that will not deform substantially at the acoustic pressures and frequencies generated by said woofer, and;

a body of sound absorbing material so shaped and disposed within said interior space behind said woofer for preventing formation of air column resonances and standing waves of said low audio frequencies within said interior space and for providing a stiff-air spring to effect a restoring force on the speaker cone of said woofer during operation of said woofer, that said enclosed interior space constitutes a low-frequency speaker enclosure for said woofer;

said body having therein a plurality of relatively large voids dimensioned for respectively storing said loudspeaker assembly and said amplifier means.

2. A loudspeaker system as defined in claim 1 wherein said shell is formed of material having a density of about 8 lb/ft$^3$.

3. A loudspeaker system as defined in claim 2 wherein said shell is coated with a high-impact polymer film.

4. A loudspeaker system as defined in claim 1 wherein said shell is thermoplastically molded polystyrene.

5. A loudspeaker system as defined in claim 1 including stiff, channeled, edging strips respectively disposed about the edges of each of said shells and adapted to mate with one another.

6. A loudspeaker system as defined in claim 5 including a resiliently deformable, flexible bead disposed between said edging strips so as to hermetically seal said interior space when said shells are mated.

7. A loudspeaker system as defined in claim 6 including a plurality of closure means coupled to the exterior portions of said shells for releasably locking said shells together.

8. A loudspeaker system as defined in claim 1 wherein said body is an open-pore polyurethane foam.

9. A loudspeaker system as defined in claim 1 wherein said system includes two of said loudspeaker assemblies, and said body includes respective voids for storing each of said loudspeaker assemblies.

10. A loudspeaker system as defined in claim 1 wherein said body includes a void for storing a sound source.

11. A loudspeaker system as defined in claim 1 including means for compressively bracing said walls against one another.

12. A loudspeaker system as defined in claim 1 including a three-channel amplifier stored in said body.

* * * * *